US007305940B2

(12) United States Patent
Nishikawa et al.

(10) Patent No.: US 7,305,940 B2
(45) Date of Patent: Dec. 11, 2007

(54) COMBUSTION-TYPE POWER TOOL HAVING IGNITION PROOF ARRANGEMENT

(75) Inventors: Tomomasa Nishikawa, Hitachinaka (JP); Yasuki Ohmori, Hitachinaka (JP); Shinki Ohtsu, Hitachinaka (JP); Kunio Yamamoto, Hitachinaka (JP); Yoshitaka Akiba, Hitachinaka (JP); Haruhisa Fujisawa, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 11/356,102

(22) Filed: Feb. 17, 2006

(65) Prior Publication Data

US 2006/0186165 A1 Aug. 24, 2006

(30) Foreign Application Priority Data

Feb. 18, 2005 (JP) ..... P2005-043276

(51) Int. Cl.
*B25C 1/08* (2006.01)

(52) U.S. Cl. ..... 123/46 H; 123/169 PH

(58) Field of Classification Search ..... 123/169 PA, 123/169 PH, 429, 430, 46 H, 298, 305
See application file for complete search history.

(56) References Cited

U.S. PATENT DOCUMENTS 4,091,774 A * 5/1978 Kamiya ..... 123/255
4,176,649 A * 12/1979 Karlovitz ..... 123/263
4,242,990 A * 1/1981 Scherenberg et al. ..... 123/263
4,522,162 A 6/1985 Nikolich
4,542,724 A * 9/1985 Blais ..... 123/266
4,974,559 A * 12/1990 Nagaoka ..... 123/169 PA
5,014,656 A * 5/1991 Leptich et al. ..... 123/169 EL
5,105,780 A * 4/1992 Richardson ..... 123/263
5,197,646 A 3/1993 Nikolich
5,799,637 A * 9/1998 Cifuni ..... 123/266
6,138,637 A * 10/2000 Bubeck ..... 123/295
6,783,047 B2 * 8/2004 Granacher ..... 227/10

FOREIGN PATENT DOCUMENTS

JP 03-025307 2/1991
JP 07-036985 2/1995

* cited by examiner

*Primary Examiner*—Noah P. Kamen
*Assistant Examiner*—Jason Benton
(74) *Attorney, Agent, or Firm*—Antonelli, Terry, Stout & Kraus, LLP.

(57) ABSTRACT

In the combustion-type power tool, a first shelter wall and a second shelter wall are disposed to partially surround an area between an ignition plug and an ignition ground. Two gaps are provided between the first and second shelter walls. The first shelter wall extends radially outwardly from an outer peripheral surface of a motor boss, and also protrudes from an end face in an axial direction of a fan shaft. The first shelter wall has a lower end surface inclined such that an axial length between the end face and the lower end surface is gradually reduced toward radially outer end of the first shelter wall.

27 Claims, 7 Drawing Sheets

COMBUSTION-TYPE POWER TOOL HAVING IGNITION PROOF ARRANGEMENT

BACKGROUND OF THE INVENTION

The present invention relates to a combustion-type power tool, and more particularly, to such power tool capable of driving a fastener of driving such as a nail, an anchor, and a staple into a workpiece by igniting a mixture of air and gaseous fuel, which in turn causes a linear momentum of a piston.

Conventional combustion-type power tools are described in U.S. Pat. Nos. U.S. Pat. No. 5,197,646 and U.S. Pat. No. 4,522,162. A conventional combustion-type power tool according will be described with reference to FIGS. 1 through 3. Throughout the specification, the term "upper" and "lower" are used assuming that the combustion-type power tool is oriented in a vertical direction. The combustion-type power tool 1 has a housing 2 constituting an outer frame and including a main housing 2A and a canister housing 2B juxtaposed thereto. The main housing 2A is formed with an exhaust port (not shown). A head cover 3 formed with an intake port (not shown) is mounted on the top of the main housing 2A. A gas canister 4 is detachably accommodated in the canister housing 2B. The gas canister 4 contains therein a combustible liquidized gas and has a gauging section 4A and an injection rod 4C extending therefrom.

A handle 5 extends from a side of the canister housing 2B. The handle 5 has a trigger switch 6. A magazine 7 and a tail cover 8 are disposed below the housing 2. The magazine 7 is adapted for containing therein nails (not shown), and the tail cover 8 is adapted for feeding the nail in the magazine 7 and setting the nail to a predetermined position. A push lever 9 is movably provided at a lower end of the main housing 2A. The push lever 9 has a tip end adapted to be pressed against a workpiece 40, and has an upper end portion associated with a link member 11 fixed to a combustion chamber frame 10 described later. A compression coil spring 30 is interposed between the link member 11 and a cylinder 20 (described later) for normally urging the push lever 9 in a protruding direction away from the head cover 3.

When the housing 2 is pressed toward the workpiece 40 while the push lever 9 is in abutment with the workpiece 40 against a biasing force of the compression coil spring 30, an upper portion of the push lever 9 is retractable into the main housing 2A.

A cylinder head 12 is secured to the top of the main housing 2A for closing the open top end of the main housing 2A. The cylinder head 12 supports a motor 13 at a position opposite to a combustion chamber 23 described later. Further, an ignition plug 14 is also supported to the cylinder head 12 at a position adjacent to the motor 13. The ignition plug 14 has an ignition spot exposed to the combustion chamber 23. The cylinder head 12 has a gas canister side in which is formed a fuel injection passage 12*a* which allows a combustible gas to pass therethrough. One end of the fuel injection passage 12*a* serves as an injection port that opens at the lower surface of the cylinder head 12. Another end of the fuel injection passage 12*a* constitutes a gas canister connecting portion which is fluidly connected to the injection rod 4C.

As shown in FIG. 2, the cylinder head 12 is formed with a disk like annular groove 12*b* having an end face 31. The end face 31 defines an upper contour of the combustion chamber 23. The cylinder head 12 has a disk like annular surface 12C surrounding the groove 12*b*. A motor boss 32 in which a motor 8 is stored protrudes from the end face 31 toward the combustion chamber 23. An ignition ground holding portion 33 protrudes from the end face 31 and extends in a generally radial direction. An ignition ground 34 is attached to the ignition ground holding portion 25 at a position in confrontation with the ignition plug 14.

The ignition plug 14 is ignitable upon manipulation to the trigger switch 6 and upon movement of the combustion chamber frame 10 to its predetermined position because of the pressing of the push lever 9 against the workpiece 40. The motor 13 has a fan shaft 13A, and a fan 15 positioned in the combustion chamber 23 is fixed to a tip end of the fan shaft 13A.

A head switch (not shown) is provided in the main housing 2A for detecting an uppermost stroke end position of the combustion chamber frame 10 when the combustion-type power tool 1 is pressed against the workpiece 40. The head switch can be turned ON when the push lever 9 is elevated to a predetermined position for starting rotation of the motor 13.

The combustion chamber frame 10 is provided in the main housing 2A and is movable in the lengthwise direction thereof. The combustion chamber frame 10 is moved interlockingly in accordance with the movement of the push lever 9, since the lower end portion of the combustion chamber frame 10 is connected to the link member 11. The cylinder 20 is fixed to the main housing 2A. The combustion chamber frame 10 has an inner surface in sliding contact with the cylinder 20. Thus, the cylinder 20 guides movement of the combustion chamber frame 10. The cylinder 20 has an axially intermediate portion formed with an exhaust hole 20*a*. An exhaust-gas check valve (not shown) is provided to selectively close the exhaust hole 20*a*.

A piston 21 is slidably and reciprocally provided in the cylinder 20. The piston 21 divides an inner space of the cylinder 20 into an upper space above the piston 21 and a lower space below the piston 21. Further, a bumper 22 is provided on the bottom of the cylinder 20. The bumper 22 is made from a resilient material. When the piston 21 moves to its bottom dead center, the piston 21 is abuttable on the bumper 22.

As shown in FIG. 3, when the upper end of the combustion chamber frame 10 abuts on the cylinder head 12, the cylinder head 12, the combustion chamber frame 10, and the upper cylinder space above the piston 21 define in combustion the combustion chamber 23.

As shown in FIG. 3, when the upper end of the combustion chamber frame 10 is separated from the cylinder head 12, a first flow passage 24 in communication with an atmosphere is provided between the combustion chamber frame 10 and the cylinder head 12, and a second flow passage 25 in communication with the first flow passage 24 is also provided between the combustion chamber frame 10 and the upper end portion of the cylinder 20. These flow passages 24, 25 allow a combustion gas and a fresh air to pass along the outer peripheral surface of the cylinder 20 for discharging these gas through the exhaust port (not shown) of the main housing 2A. Further, the above-described intake port (not shown) of the head cover 3 is formed for supplying a fresh air into the combustion chamber 23, and the exhaust hole 20*a* is adapted for discharging combustion gas generated in the combustion chamber 23.

A plurality of ribs 10A protrudes radially inwardly from the portion of the combustion chamber frame 10, the portion defining the combustion chamber 23. Each rib 10A extends in the axial direction of the combustion chamber frame 10.

The ribs 10A promote stirring and mixing of the air and the combustible gas in the combustion chamber 23 in cooperation with the fan 15.

Rotation of the fan 15 performs the following three functions. First, the fan 15 stirs and mixes the air with the combustible gas as long as the combustion chamber frame 10 remains in abutment with the cylinder head 12. Second, after the mixed gas has been ignited, the fan 15 causes turbulent combustion of the air-fuel mixture, thus promoting the combustion of the air-fuel mixture in the combustion chamber 23. Third, the fan 15 performs scavenging such that the exhaust gas in the combustion chamber 23 can be scavenged therefrom and also performs cooling to the combustion chamber frame 10 and the cylinder 20 when the combustion chamber frame 10 moves away from the cylinder head 12 and when the first and second flow passages 24, 25 are provided.

A driver blade 26 extends downwards from a side of the piston 21, the side being at the cylinder space below the piston 21, toward the lower end of the main housing 2A. The driver blade 26 is positioned coaxially with the nail set in the tail cover 8, so that the driver blade 26 can strike against the nail during movement of the piston 21 toward its bottom dead center. When the piston 21 moves to its bottom dead center, the tip end of the driver blade 26 strikes against the nail, and the piston 21 abuts on the bumper 22 and stops. In this case, the bumper 22 absorbs a surplus energy of the piston 21.

Next, operation of the combustion-type power tool 1 will be described. In the non-operational state of the combustion-type power tool 1, the push lever 9 is biased away from the cylinder head 12 as shown in FIG. 1 by the biasing force of the compression coil spring 30, so that the push lever 9 protrudes from the lower end of the tail cover 8. Thus, the uppermost end portion of the combustion chamber frame 10 is spaced away from the cylinder head 12 because the link member 11 connects the combustion chamber frame 10 to the push lever 9. Further, a part of the combustion chamber frame 10 which the part defines the combustion chamber 23 is also spaced away from the top portion of the cylinder 20. Hence, the first and second flow passages 24 and 25 are provided. In this condition, the piston 21 stays at its top dead center in the cylinder 20.

With this state, if the push lever 9 is pushed onto the workpiece 40 while holding the handle 5 by a user as shown in FIG. 3, the push lever 9 is moved toward the cylinder head 12 against the biasing force of the compression coil spring 30. At the same time, the combustion chamber frame 10 which is associated with the push lever 9 through the link member 11 is also moved toward the cylinder head 12, closing the above-described flow passages 24 and 25. Thus, the sealed combustion chamber 23 is provided.

In accordance with the movement of the push lever 9, the gas canister 4 is tiltingly moved toward the cylinder head 12 by way of a cam mechanism (not shown). Thus, the injection rod 4C of the gas canister 4 is pressed against the gas canister connecting portion of the cylinder head 12, so that the combustible liquidized gas in the gas canister 4 is injected into the combustion chamber 23 through the gauging section 4A and the fuel injection passage 12*a*.

Further, in accordance with the movement of the push lever 9, the combustion chamber frame 10 reaches its uppermost stroke end whereupon the head switch is turned ON to energize the motor 13 for starting rotation of the fan 15. Rotation of the fan 15 stirs and mixes the combustible gas with air in the combustion chamber 23 in cooperation with the plurality of ribs 10A.

In this state, when the trigger switch 6 provided at the handle 5 is turned ON, spark is generated between the end of the ignition plug 14 and the ignition ground 34 to ignite the combustible gas. The combusted and expanded gas pushes the piston 21 to its bottom dead center. Therefore, a nail in the tail cover 8 is driven into the workpiece 40 by the driver blade 26 until the piston 21 abuts on the bumper 22.

After the nail driving, the piston 21 strikes against the bumper 22, the cylinder space above the piston 21 becomes communicated with the exhaust hole 20*a*. Thus, the high pressure and high temperature combustion gas is discharged out of the cylinder 20 through the exhaust hole 20*a* of the cylinder 20 and through the check valve (not shown) provided at the exhaust hole 20*a* to the atmosphere to lower the pressure in the combustion chamber 23. When the inner space of the cylinder 20 and the combustion chamber 23 becomes the atmospheric pressure, the check valve is closed. Combustion gas still remaining in the cylinder 20 and the combustion chamber 23 has a high temperature at a phase immediately after the combustion. However, the high temperature can be absorbed into the walls of the cylinder 20 and the combustion chamber frame 10. Absorption of the heat into the cylinder 20 etc. causes rapid cooling to the combustion gas. Thus, the pressure in the sealed space in the cylinder 20 above the piston 21 further drops to less than the atmospheric pressure creating a so-called "thermal vacuum". Accordingly, the piston 21 can be moved back to the initial top dead center position.

Then, the trigger switch 6 is turned OFF, and the user lifts the combustion-type power tool 1 from the workpiece 40 for separating the push lever 9 from the workpiece 40. As a result, the push lever 9 and the combustion chamber frame 10 move away from the cylinder head 12 because of the biasing force of the compression coil spring 30 to restore a state shown in FIG. 1. Thus, the first and second flow passages 24 and 25 are provided. In this case, the fan 15 is configured to keep rotating for a predetermined period of time after the detection of the predetermined position of the combustion chamber frame 10 by the head switch in spite of OFF state of the trigger switch 6. Thus, in the state shown in FIG. 1, fresh air is sucked into the combustion chamber 23 through the intake port formed at the head cover 3 by the rotation of the fan 15. Thus, the combustion gas is urged to flow through the first and second flow passages 24, 25, and is discharged to the atmosphere through the exhaust port formed in the main housing 2A. Thus, the combustion chamber 23 is scavenged. Then, the rotation of the fan 15 is stopped to restore an initial stationary state. Thereafter, subsequent nail driving operation can be performed by repeating the above described operation process.

SUMMARY OF THE INVENTION

In the conventional combustion-type power tool 1, the spark generated between the end of the ignition plug 14 and the ignition ground 34 must not be blown out by a flow of air-fuel mixture provided by the rotation of the fan 15. To this effect, conventionally, rotation number of the fan 15 or a configuration of blades of the fan 15 are configured to avoid accidental blow-out. However, air-fuel agitation performance, combustion energy and gas blowing performance may be lowered.

It is therefore, an object of the present invention to provide a combustion type power tool provided with an arrangement that improves ignitability capable of maintaining a spark at the ignition plug against the fan flow of air-fuel mixture without lowering the performance of the fan.

This and other object of the present invention will be attained by a combustion-type power tool including a housing, a cylinder, a piston, a combustion chamber frame, a fan, an ignition unit, and a protecting member.

The housing has one end. The cylinder head is disposed at the one end and formed with a fuel injection passage. The cylinder is disposed in and fixed to the housing. The cylinder defines an axial direction. The piston is slidably disposed in the cylinder and reciprocally movable in the axial direction. The combustion chamber frame is disposed in the housing and movable in the axial direction. The combustion chamber frame is abuttable on the cylinder head to provide a combustion chamber in cooperation with the cylinder head and the piston. The fan is rotatably disposed in the combustion chamber for agitating and mixing an air with a combustible gas injected into the combustion chamber through the fuel injection passage. The ignition unit includes an ignition plug exposed to the combustion chamber, and an ignition ground. The ignition unit generates a spark between the ignition plug and the ignition ground to ignite a mixture of air and the combustible gas, to thus provide a fire. The protecting member protects the fire against a flow of the mixture of air and the combustible gas. The flow is provided by the rotation of the fan.

In another aspect of the invention, there is provided an ignition arrangement in a combustion type power tool in which a fan is provided in a combustion chamber defined by a cylinder head, a movable combustion chamber frame, a cylinder and a piston, a motive power of the piston being generated upon combustion of a mixture of air and a combustible gas in the combustion chamber. The ignition arrangement includes an ignition plug, an ignition ground, and a protecting member. The ignition plug is exposed to the combustion chamber. The ignition ground is disposed in the combustion chamber and generates a spark between the ignition plug and the ignition ground to ignite the mixture to thus provide a fire. The protecting member is disposed in the combustion chamber that protects the fire against a flow of the mixture provided by the rotation of the fan.

In another aspect of the invention, there is provided a combustion-type power tool including a housing, a combustion chamber, a fan, an ignition unit, and a flow speed decreasing member.

The housing defines an outer frame. The combustion chamber is provided in the housing. The fan is provided in the combustion chamber and mixes an air with a combustible gas injected into the combustion chamber. The ignition unit includes an ignition plug and an ignition ground. The ignition unit is provided in the combustion chamber. The flow speed decreasing member decreases a flow speed of a mixture of the air and the combustion gas running through a area between the ignition plug and the ignition ground.

DETAILED DESCRIPTION OF THE PREFERRED EMBODIMENTS

Figure 1:
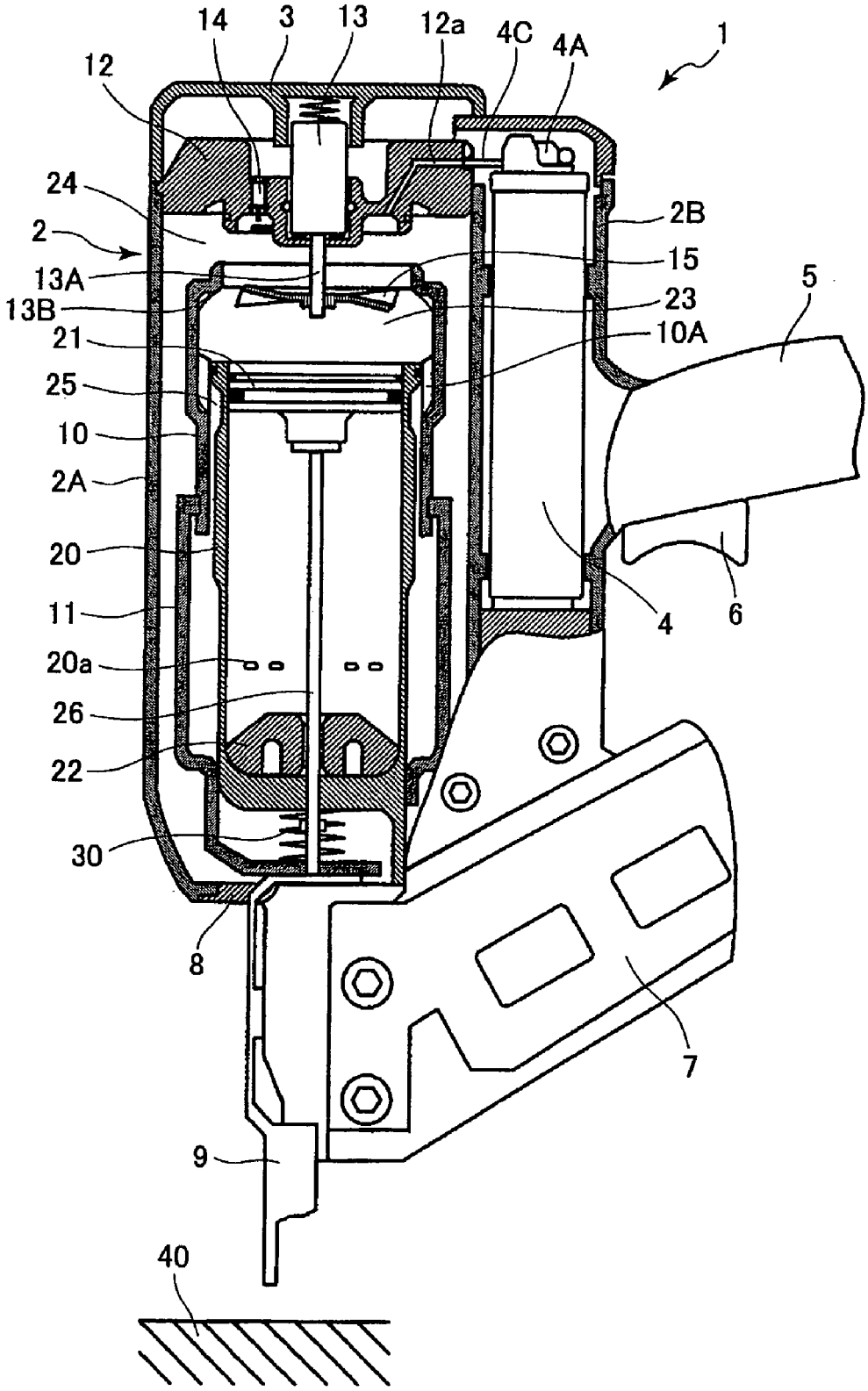
FIG. 1 is a schematic side view partly cross-sectioned showing a conventional combustion-type power tool and shows an initial state prior to fastener driving operation.

A combustion type power tool according to a first embodiment of the present invention will be described with reference to FIG. 4. A structure of the power tool is substantially the same as that of the conventional power tool shown in FIGS. 1 through 3 except for an arrangement for protecting a spark against a fan flow. Further, fundamental operation of combustion and scavenging are the same as those of the conventional operation. The same reference numeral is applied to each element as like element of the conventional power tool shown in FIGS. 1 through 3.

Figure 3:
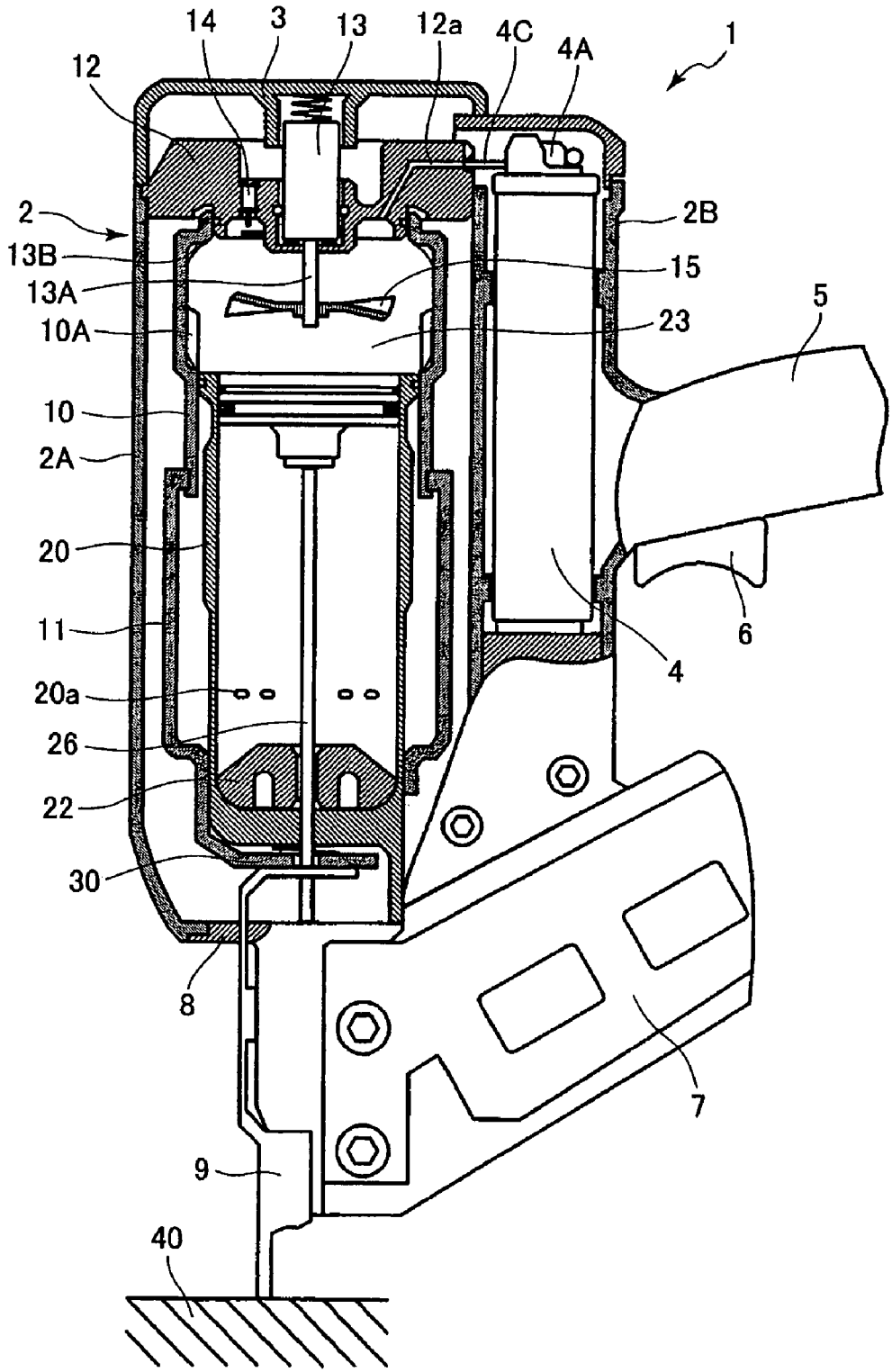
FIG. 3 is a schematic side view partly cross-sectioned showing the conventional combustion-type power tool and shows a state where a sealed combustion chamber is provided in the fastener driving operation.
Figure 4:
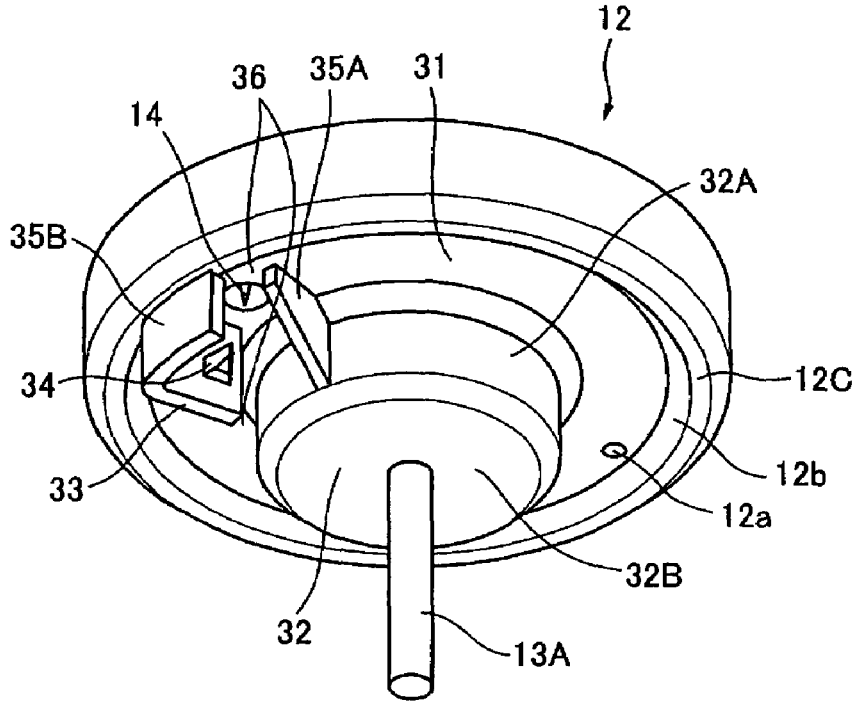
FIG. 4 is a perspective view showing an arrangement for protecting a spark against a fan flow in a combustion-type power tool according to a first embodiment of the present invention.

FIG. 4 is a perspective view particularly showing a head cover 12 as viewed from a side of a combustion chamber as indicated by an arrow A in FIG. 3. The motor boss 32 has an outer peripheral surface 32A and an end portion 32B from which the fan shaft 13A extends. A first shelter wall 35A and a second shelter wall 35B are disposed to partially surround an area between the ignition plug 14 and the ignition ground 34. Two gaps 36, 36 are provided between the first and second shelter walls 35A and 35B. The first shelter wall 35A extends radially outwardly from the outer peripheral surface 32A of the motor boss 32, and also protrudes from the end face 31 in an axial direction of the fan shaft 13A. The first shelter wall 35A has a lower end surface inclined such that an axial length between the end face 31 and the lower end surface is gradually reduced toward radially outer end of the first shelter wall 35A. The inclined end surface and the gaps 36 are required to perform cleaning to the ignition plug 9 and the ignition ground 24 and to a portion ambient thereto.

The second shelter wall 35B extends in a circumferential direction and protrudes from the annular surface 12C in the axial direction. The second shelter wall 35B is joined to a radially outer end of the ignition ground holding portion 33 so that these are integral with each other. Since the first and second shelter walls 35A and 35B are adapted to mostly surround the area between the ignition plug 14 and the ignition ground 34, a speed of air-fuel mixture running through the area can be reduced. This can prevent a fire generated by the spark from being blown off by the fan flow of air-fuel mixture. Accordingly, stabilized ignitability is attainable, and stable combustion can result.

Figure 5:
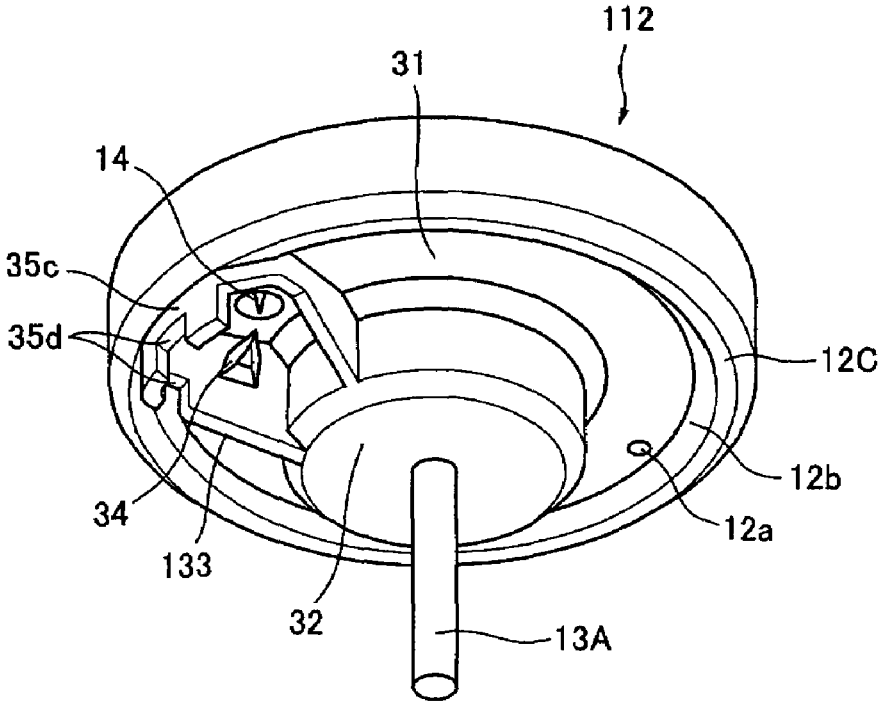
FIG. 5 is a perspective view showing an arrangement for protecting a spark against a fan flow in a combustion-type power tool according to a second embodiment of the present invention.

An essential portion of a combustion-type power tool according to a second embodiment is shown in FIG. 5, wherein the same reference numeral is applied to each element as like element in FIG. 4. In the second embodiment, one piece shelter wall 35C protrudes from the annular surface 12C in the axial direction of the fan shaft 13A. The shelter wall 35C is integral with an ignition ground holding portion 133 having the ignition ground 34. The ignition ground holding portion 133 extends radially outwardly from the outer peripheral surface 32A of the motor boss 32, and also protrudes from the end face 31 in an axial direction of the fan shaft 13A.

The single shelter wall 35C surrounds the area between the ignition plug 14 and the ignition ground 34. An inverted U-shaped notched portion 35*d* is formed at a circumferentially extending portion of the shelter wall 35C, and another inverted U-shaped notched portion 35*d* is formed at a boundary between the shelter wall 35C and the ignition ground holding portion 133. The lower surface of the notched portion 35*d* is positioned at the lower side than the end face 31. The notched portions 35*d* is functionally equivalent to the gaps 36 of the first embodiment for facilitating cleaning to the ignition plug 14 and the ignition ground 34 and to a region ambient thereto.

Figure 6:
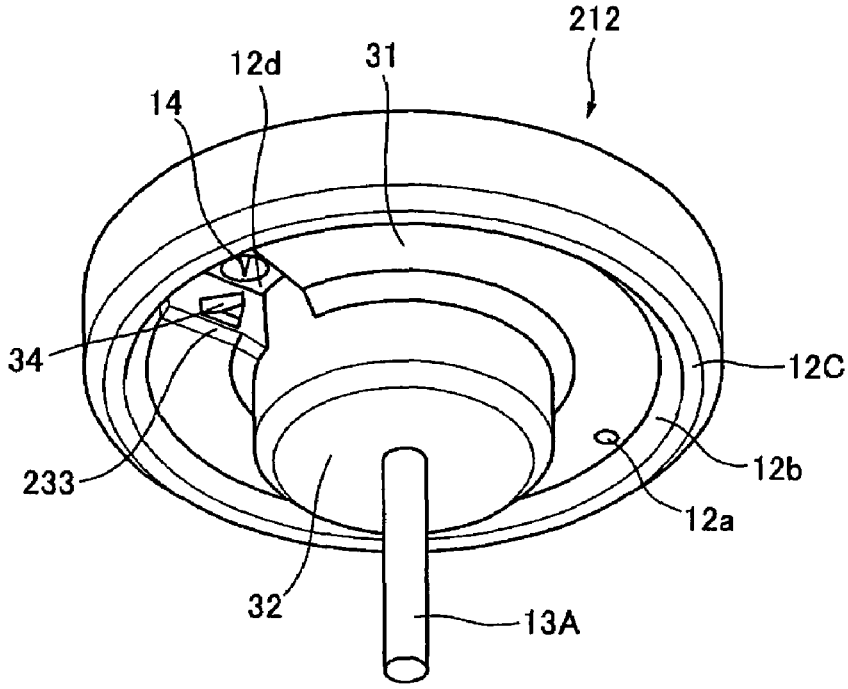
FIG. 6 is a perspective view showing an arrangement for protecting a spark against a fan flow in a combustion-type power tool according to a third embodiment of the present invention.

An essential portion of a combustion type power tool according to a third embodiment is shown in FIG. 6. In the third embodiment, a head cover 12 is engraved from the side of the end face 31 to provide a recessed space 12*d*. The recess 12*d* is defined by a pair of side walls extending in the axial direction of the fan shaft 13A and a bottom wall. One of the side walls serves as an ignition ground holding portion 233 to which the ignition ground 34 is held. The ignition plug 14 is exposed to the combustion chamber 23 (FIG. 3) through the bottom of the recess 12*d*. Since the ignition point of the ignition plug 14 and the ignition ground 34 are disposed within the recessed space 12*d*, the side walls of the recess 12*d* can serves as shelter walls. Thus, a speed of air-fuel mixture running through the area between the ignition plug 14 and the ignition ground 34 can be reduced. This can prevent or restrain a fire generated by the spark from being blown off by the fan flow of air-fuel mixture. Accordingly, stabilized ignitability is attainable, and stable combustion can result.

Figure 7:
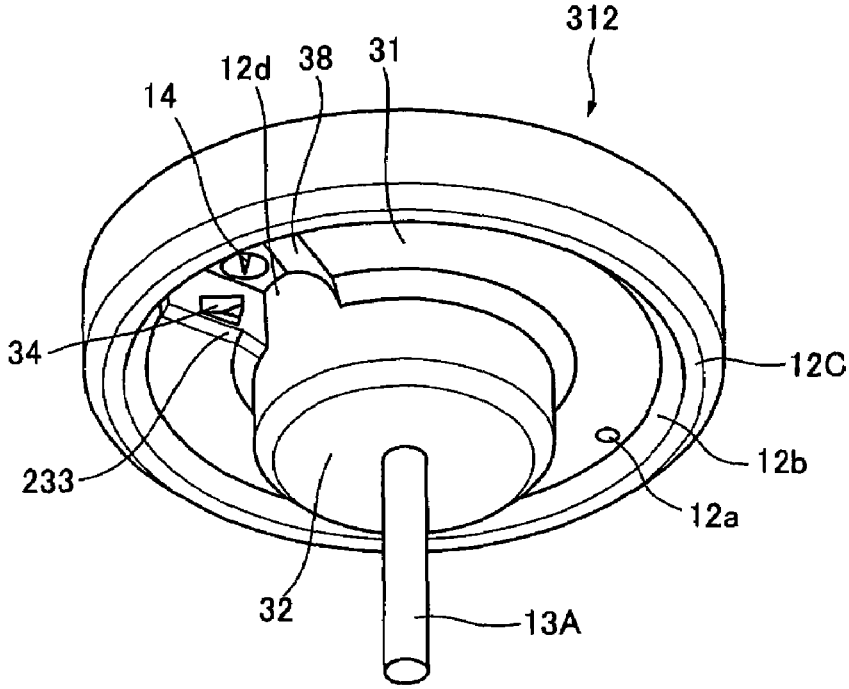
FIG. 7 is a perspective view showing an arrangement for protecting a spark against a fan flow in a combustion-type power tool according to a fourth embodiment of the present invention.

An essential portion of a combustion type power tool according to a fourth embodiment is shown in FIG. 7. This embodiment pertains to an improvement on the third embodiment in that one of the side walls 38 of the recess 12*d* formed in a head cover 12 is formed of arcuate-shaped. Since one of the side walls 38 is formed of arcuate-shaped, a cross-sectional area of the ignition plug 14 side of the recess 12*d* in the axial direction of the fan shaft 13A is larger than that of the combustion chamber 23 side of the recess 12*d*. This arcuate side wall 38 of the recess 12*d* can facilitate cleaning to the ignition plug 14 and the ignition ground 34 and a portion ambient thereto.

Figure 8:
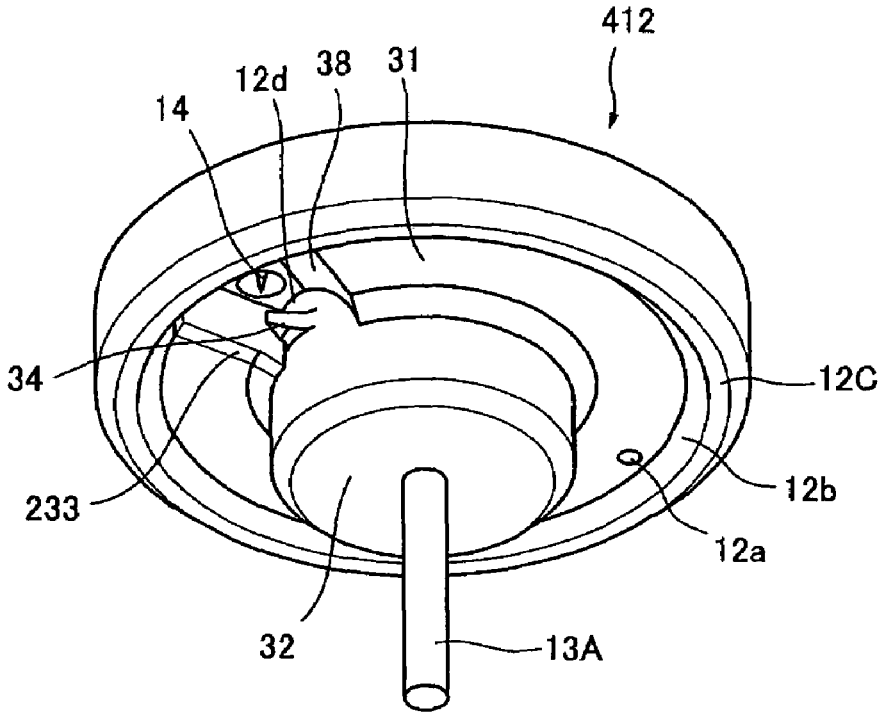
FIG. 8 is a perspective view showing an arrangement for protecting a spark against a fan flow in a combustion-type power tool according to a fifth embodiment of the present invention.

An essential portion of a combustion type power tool according to a fifth embodiment is shown in FIG. 8. This embodiment pertains to an improvement on the fourth embodiment, such that an ignition ground 34 is attached to an outer peripheral surface 32A of the motor boss 32 and within the recess 12*d*. With this arrangement, the ignition ground 34 itself can also serve as a shelter wall.

Figure 9:
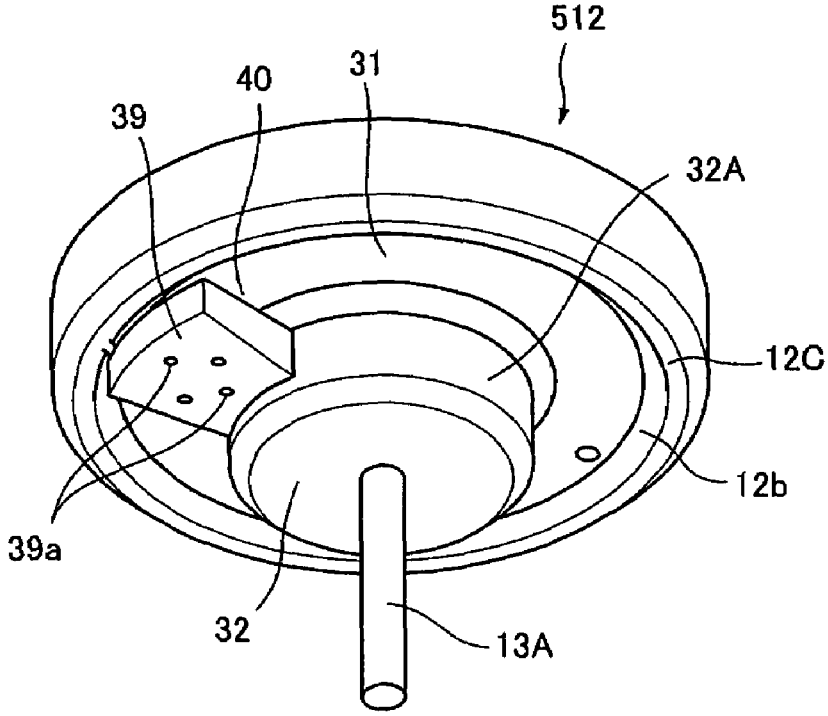
FIG. 9 is a perspective view showing an arrangement for protecting a spark against a fan flow in a combustion-type power tool according to a sixth embodiment of the present invention.

An essential portion of a combustion type power tool according to a sixth embodiment is shown in FIG. 9. This embodiment includes the ignition plug 14, the ignition ground holding portion 33 and the ignition ground 34 those being the same as those shown in FIG. 2. This embodiment further includes a shelter cover 39 fixed to the outer peripheral surface 32A of the motor boss 32 for covering the ignition ground holding portion 33, the ignition ground 34, and an ignition point of the ignition plug 14. The shelter cover 39 is formed with a plurality of communication holes 39*a*. A gap 40 is provided between the end face 31 and the shelter cover 39. These communication holes 39*a* and the gap 40 are adapted for allowing air-fuel mixture to pass threrethrough in order to expose the ignition unit to the air-fuel mixture within the shelter cover 39. The shelter cover 39 can block a flow of air-fuel mixture that may blow off a flame generated between the ignition plug and the ignition ground.

Figure 10:
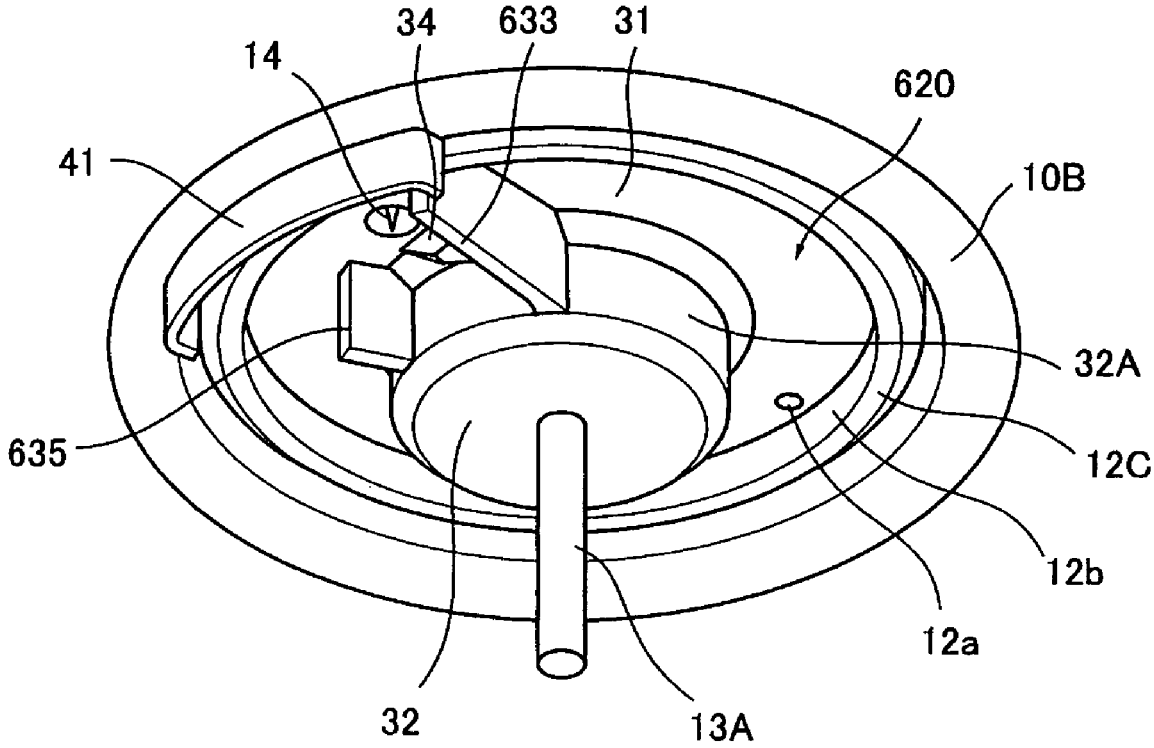
FIG. 10 is a perspective view showing an arrangement for protecting a spark against a fan flow in a combustion-type power tool according to a seventh embodiment of the present invention.

An essential portion of a combustion type power tool according to a seventh embodiment is shown in FIG. 10. In this embodiment, a combustion chamber frame 10 (FIG. 3) has an upper horizontal surface portion 10B. An ignition ground holding portion 633 radially outwardly extends from the outer peripheral surface of the motor boss 23, and the ignition ground 34 is attached to the ignition ground holding portion 633. A shelter wall 635 extends from the outer peripheral surface 32A of the motor boss 32 at a position opposite to the ignition ground holding portion 633 with respect to the ignition plug 14.

Another shelter wall 41 protrudes from the upper horizontal surface portion 10B of the combustion chamber frame 10 in the axial direction of the fan shaft 13A. The other shelter wall 41 extends in the circumferential direction of the fan and has one end positioned close to the ignition ground holding portion 633 when the combustion chamber frame 10 is positioned to provide a sealed combustion chamber 23.

With this arrangement, blow-off of a fire generated by the spark by the fan flow of air-fuel mixture can be restrained thereby providing a stabilized ignitability, yet maintaining sufficient performance of the fan to provide high agitation performance, high combustion energy and high gas flowing performance.

Figure 2:
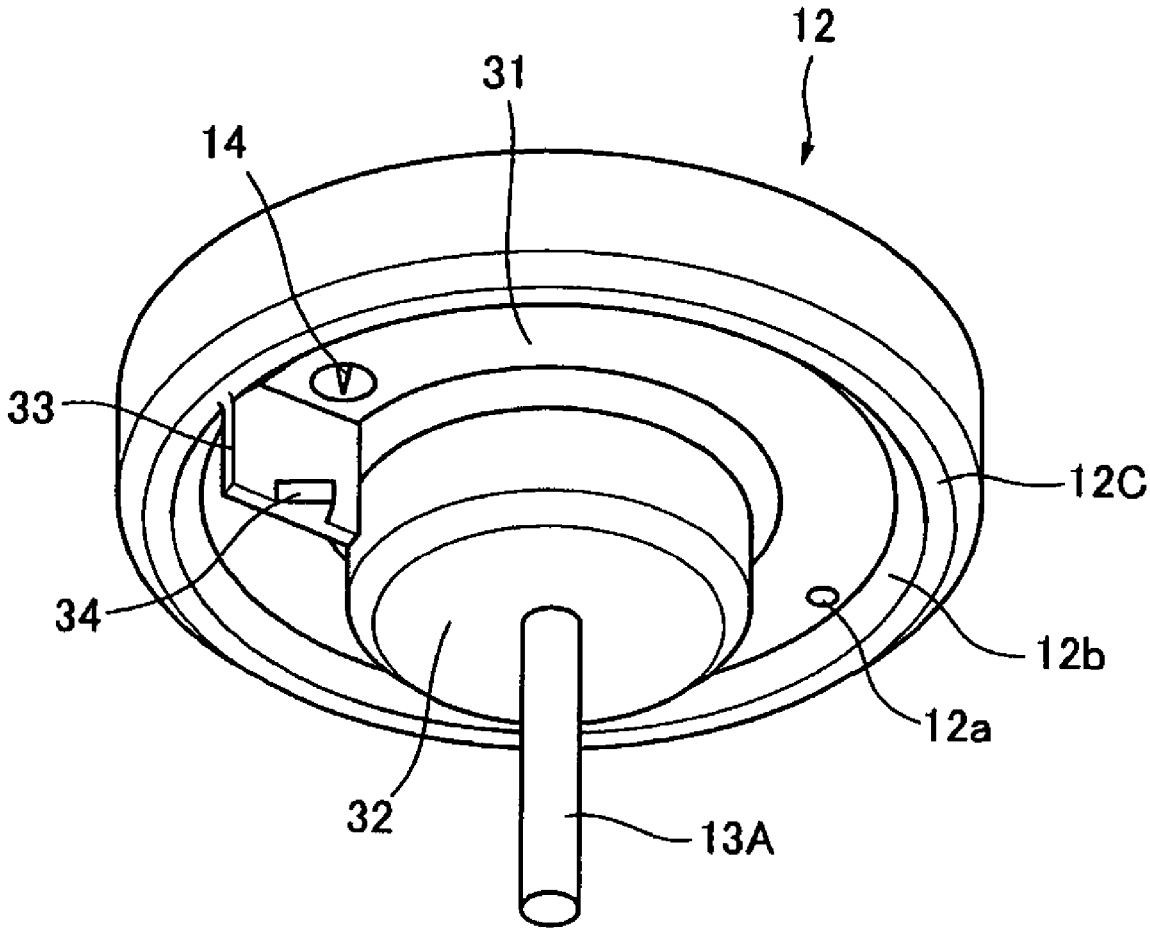
FIG. 2 is a perspective view as viewed from the combustion chamber side as indicated by an arrow A in FIG. 1.

The foregoing embodiments would provide advantage over the conventional arrangement shown in FIG. 2 where only the ignition ground 34 and the ignition ground holding section 33 are provided around the ignition plug 14 without shelter wall(s). Only the ignition ground 34 and the ignition ground holding section 33 may be insufficient to prevent or restrain a flow of air-fuel mixture from directing toward the spark generated between the spark plug 14 and the ignition ground 34. Therefore, the flow of air-fuel mixture may blow out the spark. The present embodiments can obviate such conventional drawback.

While the invention has been described in detail with reference to specific embodiments thereof, it would be apparent to those skilled in the art that many modifications and variations may be made therein without departing from the spirit of the invention, the scope of which is defined by the attached claims.

For example, as shown in FIGS. 7 and 8, while the side wall 38 is in a form of arcuate-shaped, the side wall 38 may be in a form of flat surface. That is, a radial distance between the confronting side walls 233, 38 is gradually reduced in a direction away from the combustion chamber and in the axial direction of the fan shaft 13A.

What is claimed is:

1. A combustion-type power tool comprising:

a housing having one end;

a cylinder head disposed at the one end and formed with a fuel injection passage;

a cylinder disposed in and fixed to the housing, the cylinder defining an axial direction;

a piston slidably disposed in the cylinder and reciprocally movable in the axial direction;

a combustion chamber frame disposed in the housing and movable in the axial direction, the combustion chamber frame being abuttable on the cylinder head to provide a combustion chamber in cooperation with the cylinder head and the piston;

a fan rotatably disposed in the combustion chamber for agitating and mixing an air with a combustible gas injected into the combustion chamber through the fuel injection passage;

an ignition unit comprising an ignition plug exposed to the combustion chamber, and an ignition ground that generates a spark between the ignition plug and the ignition ground to ignite a mixture of air and the combustible gas, to thus provide a fire; and a protecting member that protects the fire against a flow of the mixture of air and the combustible gas, the flow being provided by the rotation of the fan.

2. The combustion-type power tool according to claim 1, wherein the protecting member comprises a shelter wall disposed at a position adjacent to the ignition plug and the ignition ground.

3. The combustion-type power tool according to claim 2, wherein the cylinder head is formed with a recess opening to the combustion chamber, a surface of the recess defining the shelter wall, and the ignition plug being exposed to the combustion chamber through a bottom of the recess.

4. The combustion-type power tool according to claim 3, wherein the shelter wall has a part in a form of a slant surface that slants with respect to the axial direction of the piston.

5. The combustion-type power tool according to claim 1, wherein the protecting member comprises a shelter wall disposed to partially surround an area between the ignition plug and the ignition ground.

6. The combustion-type power tool according to claim 5, wherein the shelter wall is formed with a notched portion.

7. The combustion-type power tool according to claim 5, wherein the shelter wall has a slant surface that slants with respect to the axial direction of the piston.

8. The combustion-type power tool according to claim 1, wherein the protecting member comprises a cover that covers the ignition plug and the ignition ground, the cover providing a gap to allow the mixture to reach the spark.

9. An ignition arrangement in a combustion type power tool in which a fan is provided in a combustion chamber defined by a cylinder head, a movable combustion chamber frame, a cylinder and a piston, a motive power of the piston being generated upon combustion of a mixture of air and a combustible gas in the combustion chamber, the arrangement comprising:

an ignition plug exposed to the combustion chamber;

an ignition ground disposed in the combustion chamber and generating a spark between the ignition plug and the ignition ground to ignite the mixture to thus provide a fire; and a protecting member disposed in the combustion chamber that protects the fire against a flow of the mixture provided by the rotation of the fan.

10. The ignition arrangement in a combustion type power tool according to claim 9, wherein the protecting member comprises a shelter wall disposed at a position adjacent to the ignition plug and the ignition ground.

11. The ignition arrangement in a combustion type power tool according to claim 10, wherein the cylinder head is formed with a recess opening to the combustion chamber, a surface of the recess defining the shelter wall, and the ignition plug being exposed to the combustion chamber through a bottom of the recess.

12. The ignition arrangement in a combustion type power tool according to claim 10, wherein the shelter wall has a part in a form of a slant surface that slants with respect to the axial direction of the piston.

13. The ignition arrangement in a combustion type power tool according to claim 9, wherein the protecting member comprises a shelter wall disposed to partially surround an area between the ignition plug and the ignition ground.

14. The ignition arrangement in a combustion type power tool according to claim 13, wherein the shelter wall is formed with a notched portion.

15. The ignition arrangement in a combustion type power tool according to claim 13, wherein the shelter wall has a slant surface that slants with respect to the axial direction of the piston.

16. The ignition arrangement in a combustion type power tool according to claim 9, wherein the protecting member comprises a cover that covers the ignition plug and the ignition ground, the cover providing a gap to allow the mixture to reach the spark.

17. A combustion-type power tool comprising:

a housing defining an outer frame;

a combustion chamber provided in the housing a fan provided in the combustion chamber and mixing an air with a combustible gas injected into the combustion chamber;

an ignition unit comprising an ignition plug and an ignition ground, the ignition unit provided in the combustion chamber; and a flow speed decreasing member that decreases a flow speed of a mixture of the air and the combustion gas flowing through an area between the ignition plug and the ignition ground.

18. The combustion-type power tool according to claim 1, wherein the ignition plug and the ignition ground are separate members which are spaced from one another.

19. The combustion-type power tool according to claim 18, wherein the ignition ground is held on an ignition ground holding member which protrudes from an upper end face of the combustion chamber and extends in a radial direction of the combustion chamber.

20. The ignition arrangement in a combustion type power tool according to claim 9, wherein the ignition plug and the ignition ground are separate members which are spaced from one another.

21. The ignition arrangement in a combustion type power tool according to claim 20, wherein the ignition ground is held on an ignition ground holding member which protrudes from an upper end face of the combustion chamber and extends in a radial direction of the combustion chamber.

22. The combustion-type power tool according to claim 17, wherein the ignition plug and the ignition ground are separate members which are spaced from one another, and the flow speed decreasing member decreases a flow speed of the mixture in which the flow of the mixture is provided by rotation of the fan.

23. The ignition arrangement in a combustion type power tool according to claim 22, wherein the ignition ground is held on an ignition ground holding member which protrudes from an upper end face of the combustion chamber and extends in a radial direction of the combustion chamber.

24. A combustion-type power tool comprising:

a housing;

a cylinder head disposed at an end of the housing and formed with a fuel injection passage;

a cylinder disposed in the housing;

a piston disposed movably in the cylinder;

a driver blade attached to the piston;

a combustion chamber frame disposed within the housing to provide a combustion chamber;

a fan rotatably disposed in the combustion chamber; and an ignition unit comprising an ignition plug exposed to the combustion chamber, and an ignition ground that generates a spark between the ignition plug and the ignition ground to ignite a fuel/air mixture, to thus provide a fire;

wherein the cylinder head is formed with a recess portion opened to the combustion chamber, the recess portion having a bottom through which the ignition plug is exposed to the combustion chamber and having a wall extending from the bottom toward the combustion chamber to protect the fire against a flow of the fuel/air mixture provided by the rotation of the fan.

25. The combustion-type power tool according to claim 24, wherein the wall extending from the bottom toward the combustion chamber has an inclined surface which is inclined with respect to an axial direction of the piston.

26. The combustion-type power tool according to claim 24, wherein the ignition ground is disposed on the wall which extends from the bottom toward the combustion chamber.

27. The combustion-type power tool according to claim 24, wherein the wall extending from the bottom toward the combustion chamber partially surrounds an area between the ignition plug and the ignition ground.

* * * * *